US009249693B2

(12) United States Patent
Warren et al.

(10) Patent No.: US 9,249,693 B2
(45) **Date of Patent: *Feb. 2, 2016**

(54) OPPOSED PISTON DIESEL ENGINE

(75) Inventors: James C. Warren, Fairfax, VA (US); Dennis K. Scheer, Birmingham, MI (US)

(73) Assignee: WARREN ENGINE COMPANY, INC., Bluemont, VA (US)

( * ) Notice: Subject to any disclaimer, the term of this patent is extended or adjusted under 35 U.S.C. 154(b) by 1185 days.

This patent is subject to a terminal disclaimer.

(21) Appl. No.: 12/645,287

(22) Filed: Dec. 22, 2009

(65) Prior Publication Data

US 2010/0170466 A1 Jul. 8, 2010

Related U.S. Application Data

(60) Provisional application No. 61/203,701, filed on Dec. 22, 2008, provisional application No. 61/180,108, filed on May 20, 2009.

(51) Int. Cl.

| | |
|---|---|
| ***F01L 7/00*** | (2006.01) |
| ***F01L 1/30*** | (2006.01) |
| ***F01L 7/02*** | (2006.01) |
| ***F02B 75/28*** | (2006.01) |

(52) U.S. Cl.

CPC . *F01L 1/30* (2013.01); *F01L 7/029* (2013.01); *F02B 75/282* (2013.01); *F01L 2105/00* (2013.01)

(58) Field of Classification Search

USPC ..... 123/188.16, 190.1, 51 R, 51 AA, 51 BA, 123/51 BB, 51 BC, 51 BD, 188.2, 188.4, 123/90.1, 90.2, 90.21, 90.39, 90.41, 90.44, 123/58.1, 59.1, 59.3, 80 R, 81 C, 190.12, 123/190.13, 190.3, 190.4, 190.6, 190.7, 123/190.8, 190.9, 190.11, 190.14, 190.15, 123/190.2, 190.17, 59.2, 59.4, 80 BA, 123/80 BB, 80 C, 80 D, 80 DA, 81 R, 81 B, 123/81 D

See application file for complete search history.

(56) References Cited

U.S. PATENT DOCUMENTS

| | | | | |
|---|---|---|---|---|
| 2,280,079 | A * | 4/1942 | Pletcher et al. | 123/51 R |
| 4,098,238 | A * | 7/1978 | Vallejos | 123/81 B |
| 5,351,657 | A * | 10/1994 | Buck | 123/43 C |
| 5,690,069 | A * | 11/1997 | Huwarts | 123/190.2 |
| 7,004,120 | B2 * | 2/2006 | Warren | 123/43 R |
| 7,779,795 | B2 * | 8/2010 | Warren | 123/51 R |
| 2007/0017476 | A1 * | 1/2007 | Zajac et al. | 123/190.1 |
| 2007/0095320 | A1 * | 5/2007 | Warren | 123/162 |

* cited by examiner

*Primary Examiner* — Hung Q Nguyen
*Assistant Examiner* — Ruben Picon-Feliciano
(74) *Attorney, Agent, or Firm* — L.C. Begin & Associates, PLLC

(57) ABSTRACT

An opposed piston engine includes a valve mechanism for regulating fluid flow through an opening formed in a cylinder of the engine. The mechanism includes a valve operatively coupled to the cylinder so as to be rotatable to a first position to seal the opening and to a second position to unseal the opening, and at least one cam surface operatively coupled to the cylinder so as to be movable with respect to the cylinder to engage the valve so as to produce rotation of the valve.

20 Claims, 12 Drawing Sheets

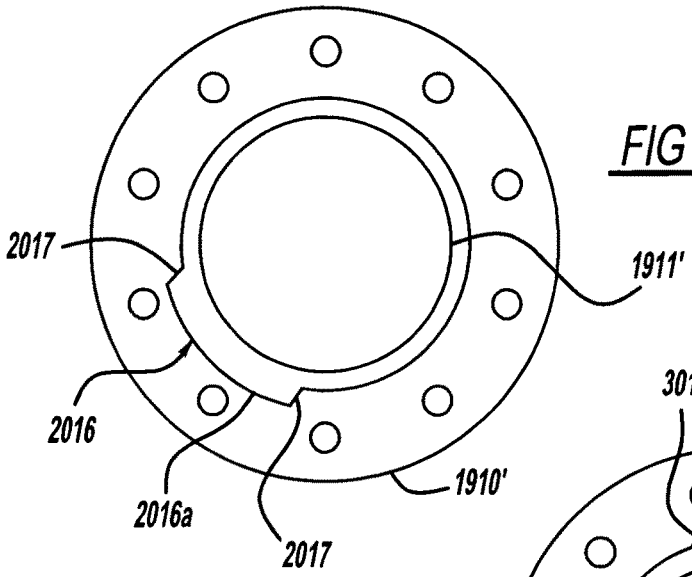
FIG - 15
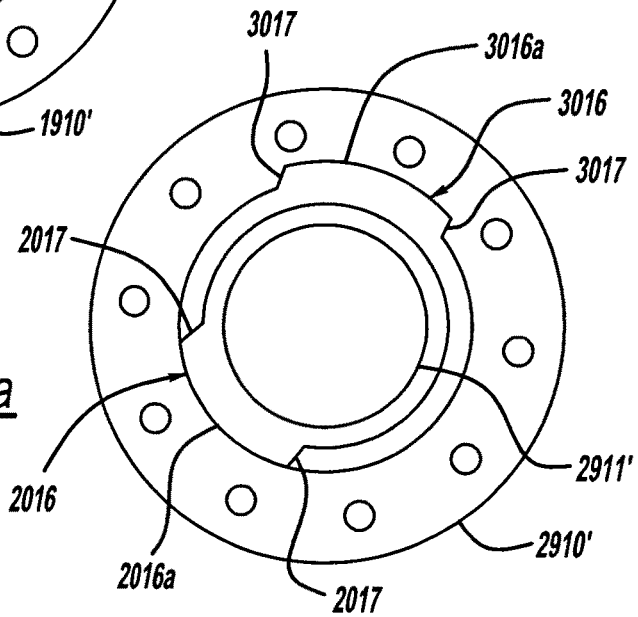
FIG - 16a
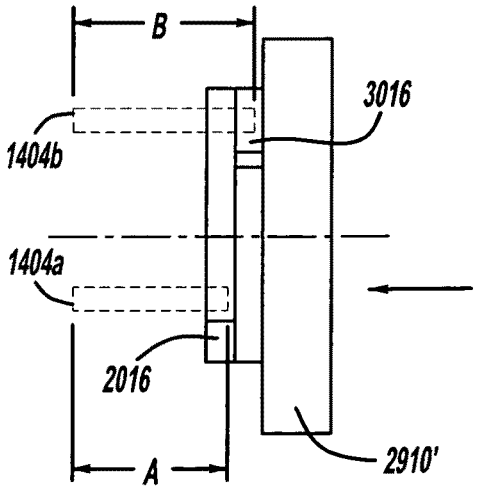
FIG - 16b
FIG - 17a
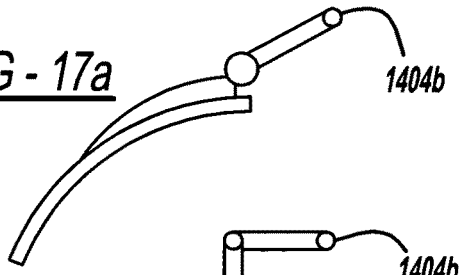
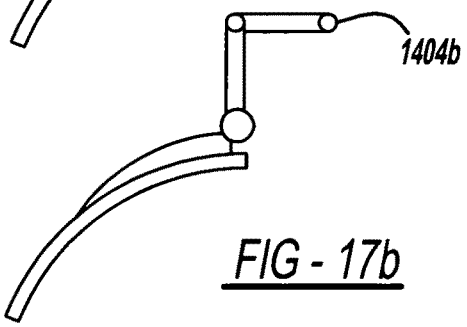
FIG - 17b

OPPOSED PISTON DIESEL ENGINE

CROSS REFERENCE TO RELATED APPLICATIONS

This application claims the benefit of provisional application Ser. No. 61/203,701, filed on Dec. 22, 2008, and of provisional application Ser. No. 61/180,108 filed on May 20, 2009, both incorporated herein by reference.

BACKGROUND OF THE INVENTION

The embodiments of the present invention relate to engines and, more particularly, to an opposed piston diesel engine.

SUMMARY OF THE INVENTION

In one aspect of embodiments of the present invention, an opposed piston engine is provided including a valve mechanism for regulating fluid flow through an opening formed in a cylinder of the engine. The mechanism includes a valve operatively coupled to the cylinder so as to be rotatable to a first position to seal the opening and to a second position to unseal the opening, and at least one cam surface operatively coupled to the cylinder so as to be movable with respect to the cylinder to engage the valve so as to produce rotation of the valve.

BRIEF DESCRIPTION OF THE DRAWINGS

FIG. 15 shows a rotatable sleeve in accordance with an embodiment of the present invention.

FIG. 16*a* is a plan view of a rotatable sleeve in accordance with an alternative embodiment of the present invention.

FIG. 16*b* is a side view of the sleeve shown in FIG. 16*a*.

FIGS. 17*a*-17*b* show valve configurations in accordance with alternative embodiments of the present invention.

DETAILED DESCRIPTION

Figure 1:
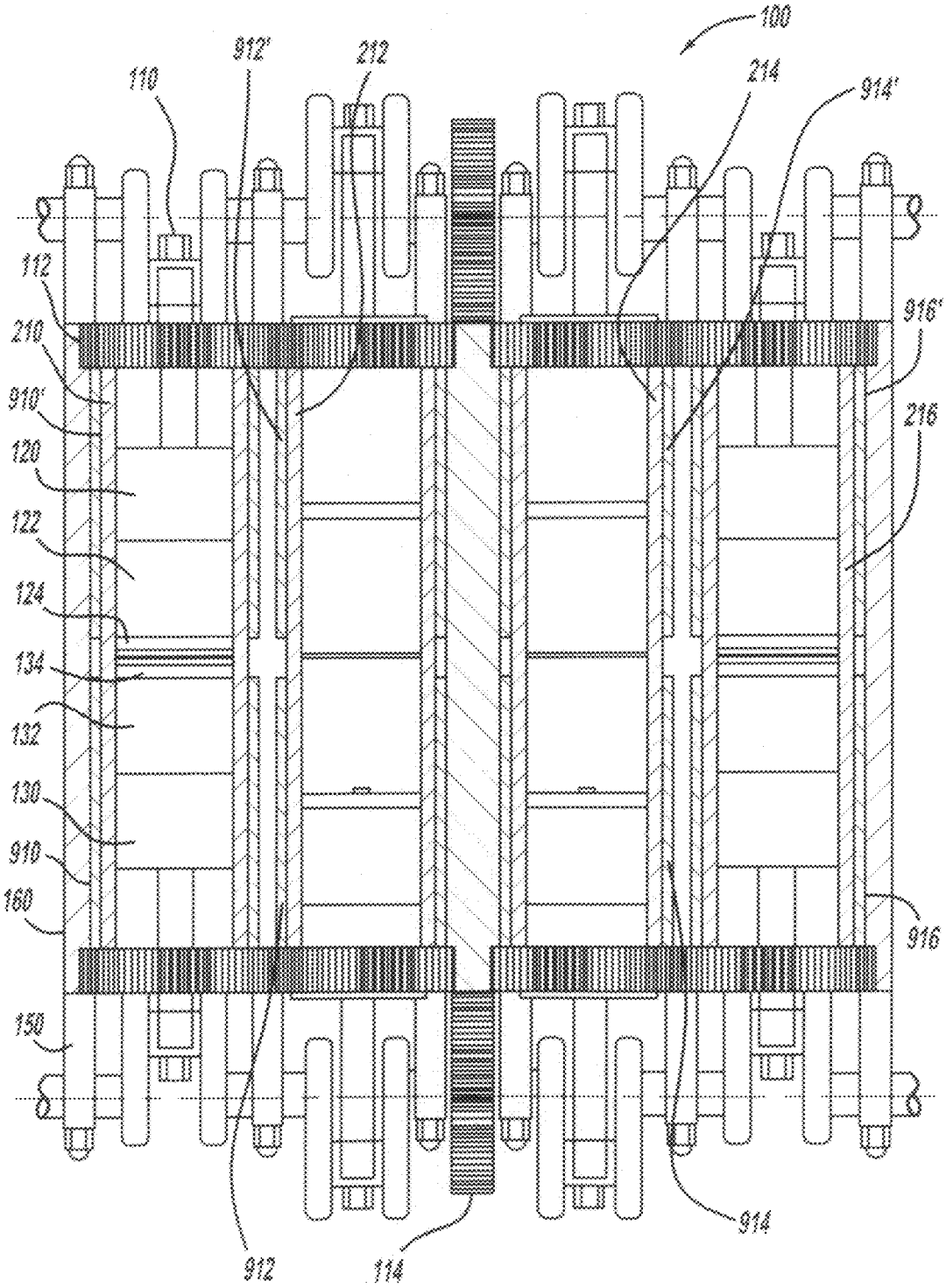
FIG. 1 is a cross-sectional view of an example of an opposed piston diesel engine according to the present invention.

Similar reference characters denote corresponding features throughout the attached drawings.

Figure 2:
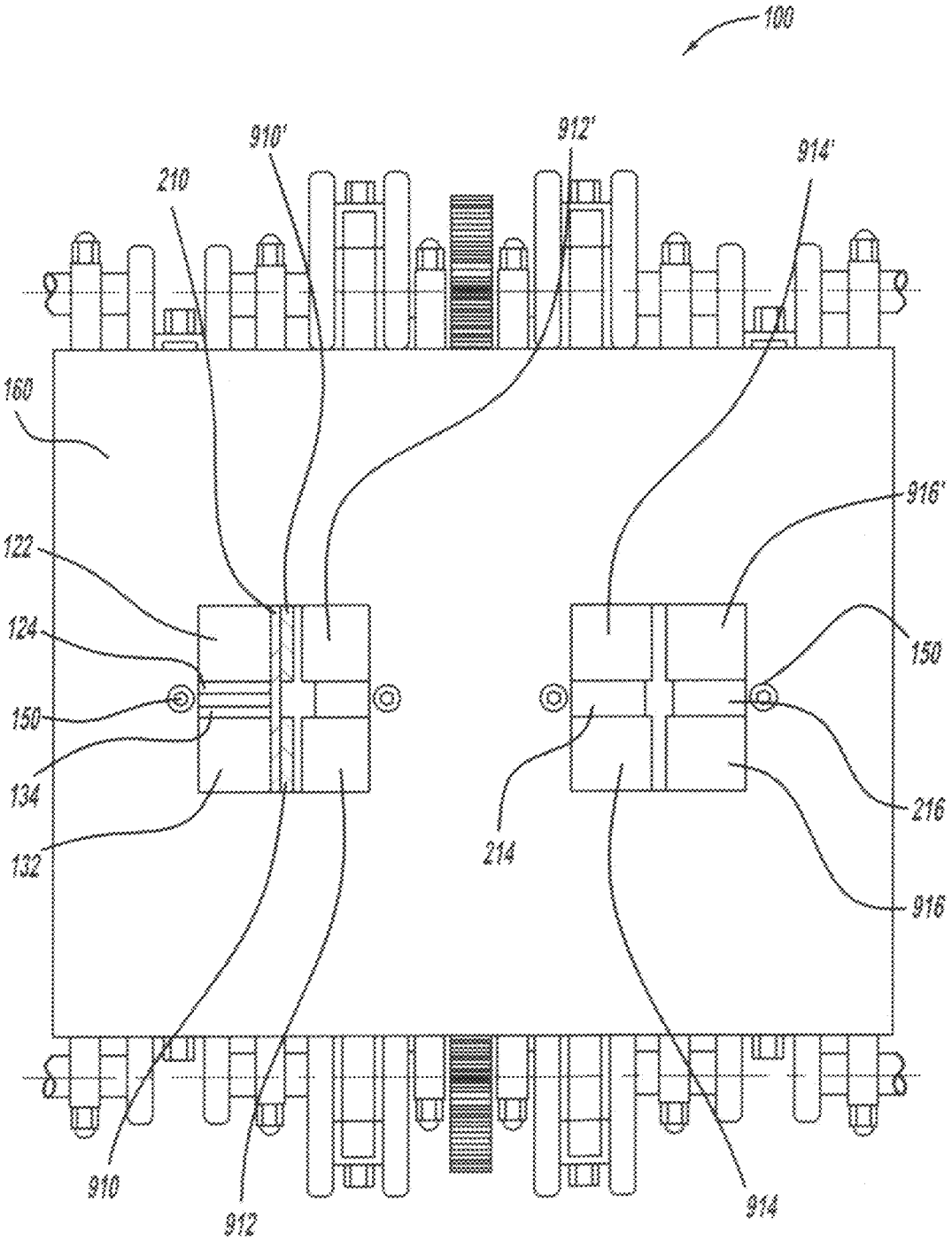
FIG. 2 is a top view of the opposed piston diesel engine shown in FIG. 1.
Figure 3:
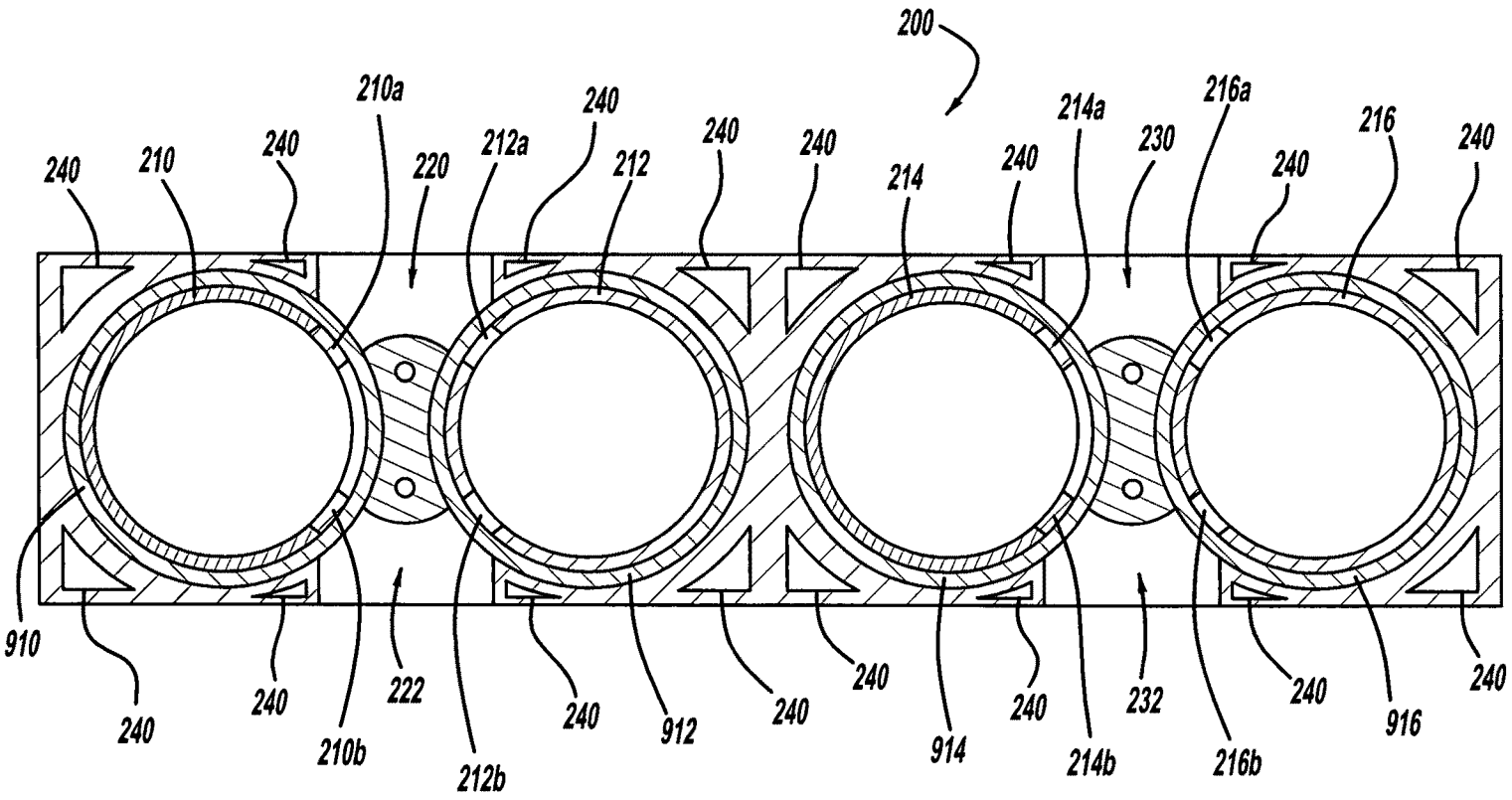
FIG. 3 is a cross sectional view of an example of a block of an opposed piston diesel engine according to the present invention.
Figure 4:
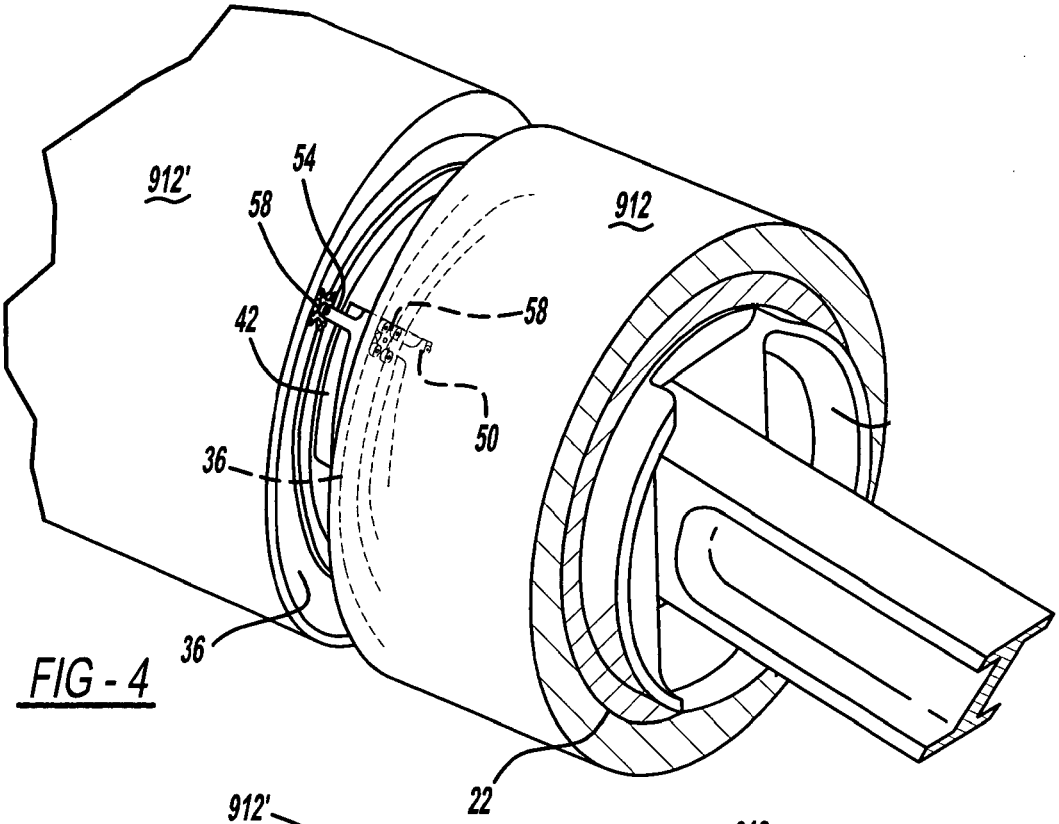
FIG. 4 is a broken away perspective view of the center of a single cylinder assembly of an opposed piston diesel engine, providing further details of the valve mechanism.
Figure 5:
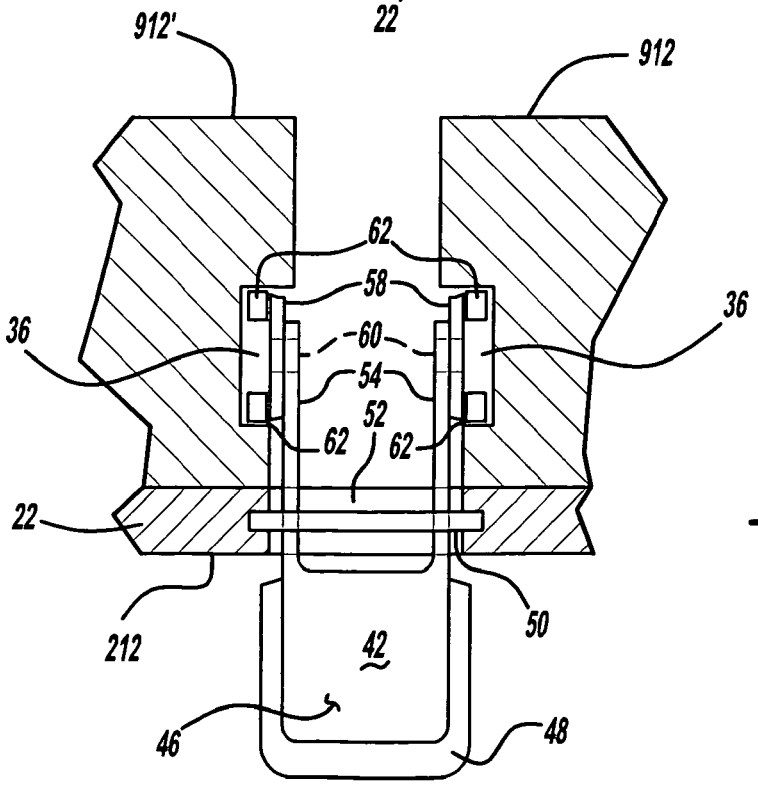
FIG. 5 is an elevation view in section through the central cylinder wall forming one side of the combustion chamber of the engine, showing further details of the valve assembly.

Referring to the drawings, an opposed piston diesel engine according to one embodiment of the present invention is shown in FIGS. 1-3. The arrangement shown is similar to embodiments of an opposed piston internal combustion engine described in U.S. Pat. No. 7,004,120, incorporated herein by reference. The embodiment 100 of the opposed piston diesel engine shown in FIGS. 1-3 is a four-cycle or four-stroke engine and while it is illustrated with four cylinders 210, 212, 214, and 216, any number of cylinders may be utilized depending on the amount of power desired to be produced by the engine 100. In addition, the structural arrangements and operating principles described herein may alternatively be applied to a two-stroke engine.

Referring to FIG. 1, each cylinder 210, 212, 214, and 216 of the engine forms (in conjunction with opposed pistons 120 and 130 disposed within the cylinder) a combustion chamber for the air-fuel combustion reaction. Each cylinder is associated with a respective pair of rotating outer sleeves 910, 910', 912, 912', 914, 914', and 916, 916' (e.g., sleeves 910 and 910' enclose cylinder 210 in FIG. 1), FIG. 1 shows rotating sleeves 912, 912' associated with cylinder 212, sleeves 914, 914' associated with cylinder 214, and sleeves 916, 916' associated with cylinder 216. An engine block or cylinder case 160 of the engine encloses the cylinder assemblies and opposed pistons. Each sleeve has camming surfaces formed in end portions thereof for purposes described in greater detail below. Each cylinder is also associated with a pair of connecting rods 110, a pair of opposing gears 112, opposing first and second pistons 120 and 130 that are each interconnected with a connecting rod 112, first and second opposing piston caps 124 and 134, and a pair of bearing caps 150. Optional first and second opposing cylindrical spacers 122 and 132 may be affixed to respective ones of the opposed pistons for purposes described below.

A gear 112 is attached to each end of an associated rotating sleeve and is driven by a gear 114 sharing the same axis as the associated crankshaft (not shown), to rotate the sleeve. Each associated crankshaft is configured to provide predetermined stroke lengths to the first and second pistons 120 and 130 residing within each cylinder. The opposed first and second pistons 120 and 130 may be of a relatively standard design, and have predetermined lengths and predetermined diameters.

Cylinders 210, 212, 214, 216 reside within respective outer sleeves 910, 910', 912, 912', 914, 914', and 916, 916' as shown in FIG. 1. Cylinders 210, 212, 214, 216 are also stationary with respect to the rotating sleeves. The gears 112 are configured to rotate each associated sleeve at a speed of one half crank speed, and each sleeve has a predetermined length. The sleeves of each pair of sleeves associated with an individual cylinder rotate in conjunction with each other, at the same speed and in the same direction. Sleeve or plain bearings (not shown) or any other suitable bearings may be positioned between the cylinders and their respective sleeves to facilitate rotation of the sleeves with respect to the cylinders. Similarly, sleeve or plain bearings (not shown) or any other suitable bearings may be positioned between the rotating sleeves and the engine block 160 to facilitate rotation of the sleeves with respect to the engine block 160. One source of suitable bearings for this application is GGB Bearings of Thorofare, N.J.

Referring to the arrangement within cylinder 210 of FIG. 1 as exemplary, optional first and second cylindrical spacers 122 and 132 may be affixed to the faces of the associated pistons 120 and 130. The optional spacers 122 and 132 are not necessary but may be utilized to provide correct piston lengths for controlling spacing between the piston faces, thereby providing a means for adjusting the compression ratio and generally providing a predetermined degree of compression for heating intake air to facilitate combustion of a fuel injected or otherwise inserted into the combustion chamber. The piston lengths are geometrically determined in accordance with the piston stroke length and the lengths of apertures (described below) formed in the cylinders through which flow exhaust gases and air for combustion.

Referring again to cylinder 210 of FIG. 1, first and second piston caps 124 and 134 are attached to faces of associated ones of pistons 120 and 130 (or to associated optional cylindrical spacers 122 and 132 in an embodiment where spacers are used). In one embodiment, each piston cap 124 and 134 is formed from a sandwich of two sheets of carbon fiber with a ceramic center. The piston caps 124 and 134 which are exposed to the combustion event are slightly concave in form so that when the two piston caps 124 and 134 meet in the center of the cylinder they form a somewhat spherical combustion chamber. Only the ceramic cores of the piston caps 124 and 134 actually come into contact with the stationary cylinder wall. A bearing cap 150 is mounted on each end of each rotating cylinder.

The piston should have a length from the fire ring to the cap suitable for keeping the piston rings out of the aperture. The optional spacers 122 and 132, and piston caps 124 and 134 each have a diameter roughly equal to the interior of the associated cylinder, and may be made of carbon fiber, ceramic, or any other suitable material to aid in minimizing thermal inefficiencies during engine operation.

An external view of the opposed piston diesel engine 100 is shown in FIG. 2, illustrating the block 160 itself with the intake plenums exposed. In FIGS. 1 and 2, the first and second pistons 122 and 134 in the far left cylinder 210 are at the apex of their stroke, at which they would not be exposed during the actual operation of the engine 100. An exemplary fuel injector 150 is shown for providing fuel to cylinder 210 at an appropriate point in the diesel engine cycle, as is known in the art.

A cross section of an engine block 200 showing two intake plenums 220 and 230, and two associated exhaust plenums 222 and 232 is illustrated in FIG. 3. Cooling channels 240 are also illustrated. Two cylinders 210 and 212 share a common intake and exhaust runner. In the embodiment shown in FIG. 3, each runner, after branching off from the plenum, extends about sixty degrees along the outside diameter of the outer cylinder and is equal in length to the combined stroke lengths of both pistons. Various other conventional components of a diesel engine, e.g., cooling system, mechanical fasteners, etc., are not shown in the drawings in order to provide greater clarity for the inventive features shown therein.

Referring to FIG. 3, each of cylinders 210, 212, 214, 216 has a pair of apertures or valve ports formed therealong and positioned so as to enable fluid communication between an interior of the cylinder and the associated intake and exhaust runners. Only the apertures formed along cylinder 210 will be described for simplicity. However, it will be understood that cylinders 212, 214, and 216 incorporate similar features arranged so as to facilitate execution of the diesel engine cycle described herein.

Referring to cylinder 210 of FIG. 3, the cylinder includes a pair of apertures 210*a* and 21011 formed therein, each aperture being aligned with a corresponding one of intake plenum 220 and exhaust plenum 222. In the embodiment shown in FIG. 3, apertures 210*a* and 210*b* are angularly spaced apart approximately 90° and each encompasses an arc of approximately 60°. However, other aperture sizes and angular arrangements may be used according to the requirements of a particular application. In addition, each aperture is associated with a respective valve mechanism (not shown in FIG. 3) which is actuated responsive to the portion (i.e., intake, compression, power, or exhaust) of the engine cycle occurring in the cylinder at any given moment, as described in further detail below. The cylinder valve mechanism opens to admit air into the interior of cylinder 210 for compression by pistons 120 and 130, and also opens to eject combustion exhaust from the cylinder interior after combustion has taken place. In addition, in the manner described below, cam surfaces formed in associated sleeves 910 and 910' actuate the valve mechanisms associated with each of cylinder apertures 210*a* and 210*b*.

Referring now to FIGS. 4-7, each valve mechanism for embodiments of the opposed piston diesel engine described herein essentially comprises a single poppet type valve opening into the common combustion chamber between the two opposed pistons in each cylinder pair. The arrangement shown is similar to embodiments of a valve mechanism described in U.S. Publication No. 2009/0173299, incorporated herein by reference. The engine configuration to which the poppet valve mechanism is adapted includes a valve rotatably coupled to the stationary cylinder, and the rotating sleeves surrounding each cylinder. The valve is pivotally attached at one side or end thereof to the edge of the valve port of the cylinder surrounding the pistons, and is actuated by an arm or arms having guides (rollers, etc.) at the distal end(s) thereof, which are captured in corresponding cam track(s) or channel(s) formed in the rotating sleeves.

The engine and valve system operate by gearing or otherwise driving the rotation of the sleeves to correspond with the reciprocation of the pistons of each pair. The cylinder valve ports extend about a portion of the circumferential periphery thereof and are aligned with intake and exhaust runners as previously described, with a single valve disposed across or over each port. As the sleeves rotate about the cylinders, guides attached to the valve actuation arms ride along the cam surfaces or tracks formed in the sleeves. The cam track(s) vary in height or radial distance from the center of the cylinder in their path(s) about the cylinder. As the valve guide(s) travel in the variable radius cam track(s), the valve is periodically pushed inwardly toward the center of the cylinder to open the valve port, and alternately lifted away from the inward position to close the valve port of the inner cylinder. The opening and closing of the valve port permits inflow of intake charges and outflow of exhaust gases from the combustion chamber.

Details of the structure and operation of the valve mechanisms are now described with reference to FIGS. 4-7. FIGS. 4-7 illustrate a portion of only a single one 912' of the rotary outer sleeves and a single stationary cylinder 212 with a single piston 120 shown therein, in order to simplify the illustrated mechanism and clarify a valve mechanism in accordance with embodiments of the present invention.

As seen in FIGS. 4-7, in one embodiment, separate valve ports 212*a*, 212*b* are formed in the cylinder 212 opposite each of the intake manifold and the exhaust manifold, as previously described. The valve ports 212*a*, 212*b* are located in the inner cylinder approximately medially of each piston pair, i.e., proximate and in fluid communication with the combustion chamber defined by the cylinder 212 and its two opposed pistons 120 and 130.

In the embodiment shown in FIGS. 4-7, valve mechanisms 42 and 44 used are similar to the cam-actuated valves described in U.S. Application Ser. No. 60/561,353, incorporated herein by reference. These valve mechanisms include valve members that are connected via hinges to the cylinders and which are actuated as described in the incorporated U.S. patent application, by engagement between actuating members, cam following members, and cam channels formed in the rotating sleeves of embodiments of the present invention. Other suitable alternative valve mechanisms may be used.

In the embodiment shown in FIGS. 4-7, each of the valve mechanisms 42 and 44 essentially comprises a curved plate having a combustion chamber face 44 with a curvature closely conforming to the curvature of the internal cylinder wall 40. Each valve mechanism further includes a back 46 opposite the face 44, and a sealing periphery 48. First and second pairs of opposed actuating arms 54 and 55 extend from the back of the valve. The pairs of actuating arms 54 and 55 extend outwardly adjacent to opposite sides of the inner cylinder valve port 38.

A first valve attachment hinge 50 connects one edge of the valve periphery 48 to actuating arms 54, while a second valve attachment hinge 51 connects an opposite edge of the valve periphery 48 to actuating arms 55. Thus, each of the actuating arms is connected to the back of the valve via a hinge or other mechanism permitting relative rotation between the respective arm and the valve back 46.

Referring again to FIGS. 4-7, each of the actuating arms in pairs 54 and 55 terminates in a distal end having a cam follower mechanism 58 extending therefrom and riding in corresponding cam channels 36 of the sleeves 912, 912'. In the embodiment shown, the cam follower mechanism is resiliently attached to the distal end 56 of the actuating aim 54 by a resilient bushing connector 60 or the like that permits limited relative movement between the can follower mechanism 58 and the actuating arm 54. This provides allowance for any small tolerance buildups or dimensional changes due to thermal expansion as the engine 100 is operated. The cam follower mechanism includes at least one cam channel roller 62 extending therefrom and riding within a corresponding cam channel 36.

In the embodiment shown in FIGS. 4-7, the cam follower mechanism 58 is in the form of a "spider" having a series of radially extending arms, with each of the arms having a separate roller 62 extending therefrom. The rollers 62 comprise small roller bearings that ride against the corresponding inner and outer surfaces of the cam channels 36. As the radius of the cam channels 36 vary around the cylinder 22, the rollers are forced radially inwardly and outwardly, thereby driving their attached cam follower mechanisms 58 and valve actuating anus 54 inwardly and outwardly to open and close the valve 42. Other, alternative methods of valve actuation are also contemplated.

As described in greater detail below, the sleeves 912 and 912' rotate to actuate the valves 42 and 44, thereby enabling fluid communication between the interior of cylinder 212 and the separate intake and exhaust passages.

Referring to FIGS. 4-7, the rotating sleeve 912' includes at least one cam channel 36 fanned therein. The cam channel(s) 36 formed in rotating sleeve 912' have variable radii in order to actuate the valve mechanism during rotation of the outer cylinder, as described in detail further below.

In one embodiment, a single cam channel 36 is provided in sleeve 912' for guiding the cam follower mechanism 58. However, in the particular embodiment shown in FIGS. 4-7, it will be understood that a symmetrical valve actuation system of at least two opposed circumferential cam channels 36 in sleeves 912 and 912' and corresponding symmetrically opposed linkages between the cam channels and the valve, is provided.

FIGS. 4-7 illustrate the sequence of valve operation through essentially one clockwise revolution of the sleeve 912' about the stationary cylinder 212. The variable radius cam channel 36 includes a larger radius valve closed portion 36*a*, a decreasing radius ramp portion 36*b* causing each of valves 42 and 44 to move from a closed to an open position, a relatively smaller radius valve open portion 36*c*, and an increasing radius ramp portion 36*d* which causes the valves to move from open positions to its closed positions along the larger radius channel portion 36*a*.

Operation of the sleeves and valves during the diesel engine cycle is described as follows, with reference to cylinder 212 and associated sleeves 912, 912'. It will be understood that the remainder of the sleeves and valves also operate in the manner described.

Figure 6:
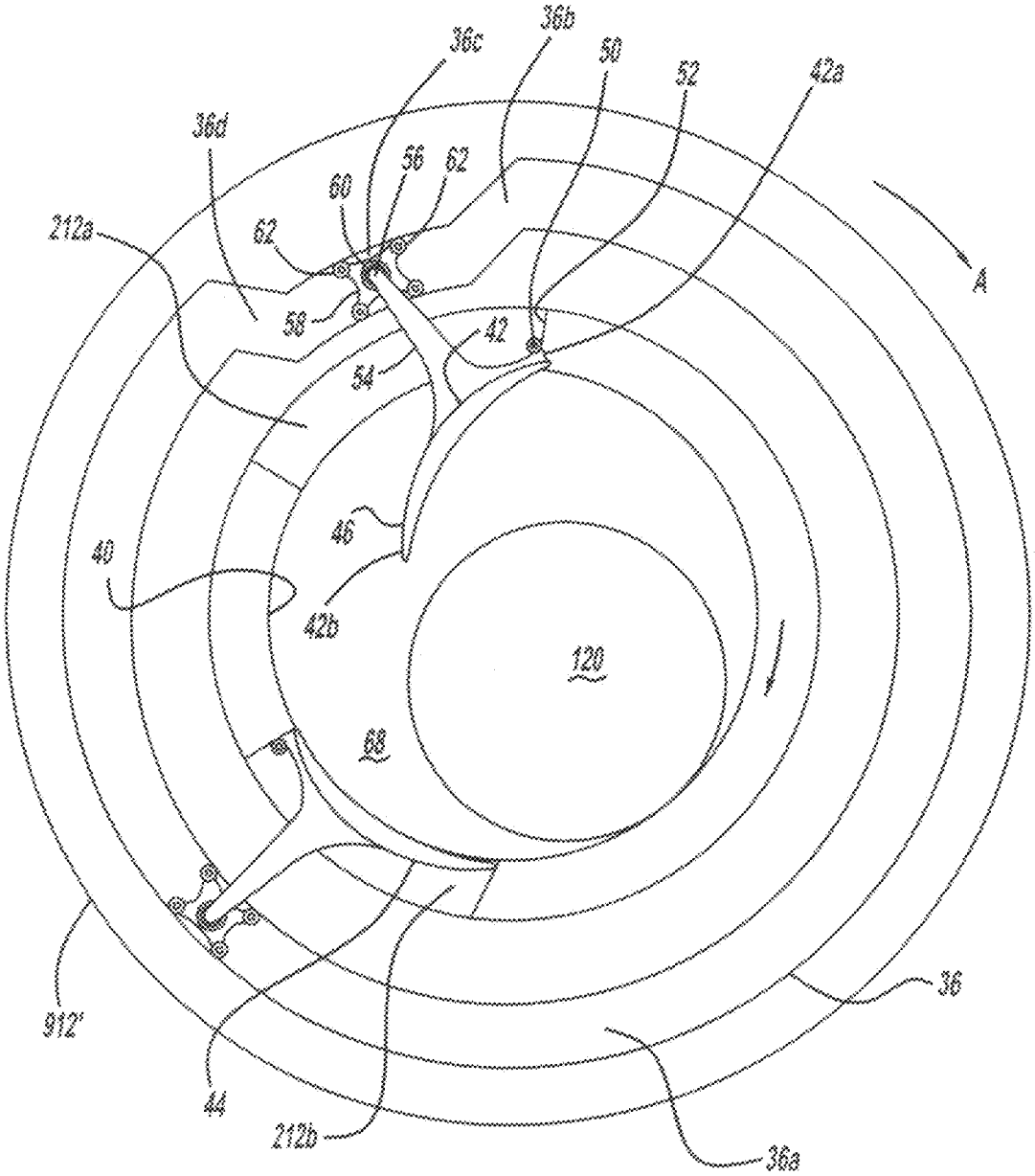
FIG. 6 is a cross-sectional view across a single combustion chamber of the engine, showing the rotation of a sleeve and resulting actuation of the valve during the intake portion of the diesel engine cycle.

Referring to FIG. 6, at the beginning of the combustion cycle, exhaust gasses have been purged and the pistons and associated piston caps within cylinder 212 are at top dead center.

FIG. 6 shows a configuration of one sleeve 912' of the system during an intake stroke of the cycle. As seen in FIG. 6, the sleeve 912' rotates within the cylinder case 160 in the direction indicated by arrow "A", thereby causing the cam channels engaging the valve actuating mechanism 58 to travel around the circumference of the cylinder 212. As the sleeve 912' rotates and the radius of the cam channel 36 with respect to cylinder 212 varies, so does the distance between the valve actuating mechanism 58 and the center of the cylinder 212 as the outer cylinder rotates.

One edge 42*a* of the valve 42 is fixed at a substantially constant radius from the center of the cylinder 212 due to the valve hinge mechanism 50 and the movement of cam follower mechanism 58 within cam channels 36. However, an opposite edge 42*b* of valve 42 is forced to open toward the center of the cylinder 212 as the actuating mechanism 58 reaches the smaller radius portion 36*c* of the cam channel 36. This edge of the valve rotates about the hinge mechanism 50, thereby opening the valve to admit air for compression and combustion through cylinder opening 212*a*.

As seen in FIG. 1, sleeves 912 and 912' are spaced apart. Also, as seen in FIGS. 4-7, a valve is positioned in each of cylinder openings 212*a* and 212*b* to control fluid flow through the opening, and each valve has cam followers engaging the cam surfaces in each sleeve. Thus, each valve straddles the gap between the sleeves to engage cam surfaces formed in each sleeve.

In FIG. 6, when valve 42 is forced open by rotation of the sleeves 912' and 912 (not shown in FIG. 6) and corresponding movement of the cam follower mechanism 58 along the cam channels, movement of the pistons in cylinder 212 away from each other causes air to be drawn into the inner cylinder combustion chamber.

When the piston caps 124 and 134 (FIG. 1) are halfway to bottom dead center, the aperture 212*a* is completely open and air has entered the interior of cylinder 212 for compression. By the time the pistons 120 and 130 are at bottom dead center, sleeves 912 and 912' have rotated in direction "A" to where the cam follower mechanism of valve 42 has engaged larger radius valve closed portions 36*a* of sleeves 912 and 912', drawing the valve actuating mechanism 58 outwardly away from the center of the cylinder 212, thereby closing the edge 42*b* of the valve 42. At this point, the compression stroke is commencing. In addition, the cam follower mechanism associated with valve 44 is engaged with larger radius valve closed portions 36*a* of sleeves 912 and 912*a*. Thus, valve 44 regulating flow between the interior of cylinder 212 and the exhaust runner is closed.

With both of valves 42 and 44 closed, as the pistons 120 and 130 within cylinder 212 are forced to the center of the cylinder, the air in cylinder 212 is compressed between the pistons. When opposed pistons 120 and 130 are at or near their points of closest approach to each other, the air in the combustion chamber has been compressed and is at or near its maximum pre-combustion temperature. At or near this point, fuel is injected into the combustion chamber between the two pistons and ignited by heat from the compressed air, as is known in the art. Injection of fuel into the combustion chamber may be undertaken using any of a variety of known mechanisms and/or methods. At the same time, while pistons 120 and 130 are approaching each other, sleeves 912 and 912' continue to rotate in conjunction with each other in the direction indicated by arrow "A" of FIG. 6.

Combustion of the fuel produces expanding gases, forcing the opposed pistons in opposite directions. This initiates the power stroke of the engine cycle. It will be seen that, as cam follower mechanism 58 is traveling along the relatively larger radius portion of cam channel 36 during the compression and combustion cycles, valves 42 and 44 are closed during the compression and combustion cycles described above.

During the power stroke, the pistons 120 and 130 move away from each other as the force of the expanding gasses dictates. At the same time, while pistons 120 and 130 are drawing away from each other, sleeves 912 and 912' continue to rotate in conjunction with each other in the direction indicated by arrow –A" of FIG. 6.

Figure 7:
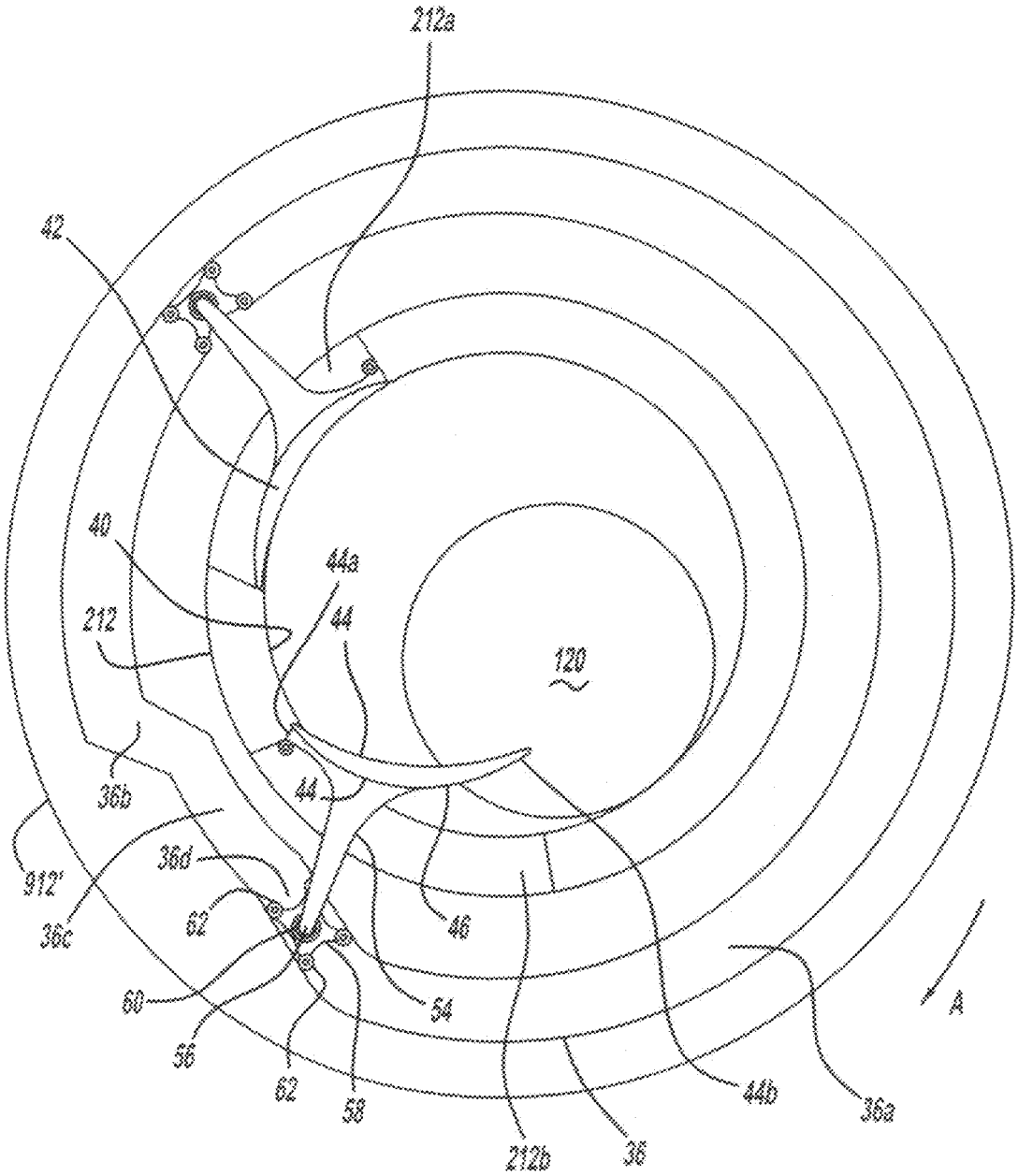
FIG. 7 is a cross-sectional view across a single combustion chamber of the engine, showing the rotation of a sleeve and resulting actuation of the valve during the exhaust portion of the diesel engine cycle.

FIG. 7 shows a configuration of the system during an exhaust stroke of the cycle when the opposed pistons in cylinder 212 are approaching each other after completion of the power stroke. As seen in FIG. 7, the sleeves 912 (not shown in FIG. 7) and 912' rotate within the cylinder case 160 in the direction indicated by arrow "A⁻, thereby causing the cam channels engaging the valve actuating mechanism 58 to travel around the circumference of the cylinder 212. As the radius of the cam channel 36 with respect to cylinder 212 varies, so does the distance between the valve actuating mechanism 58 and the center of the inner cylinder 22 as the outer cylinder rotates.

As rotation of the sleeves 912, 912' continues, the cam follower mechanism associated with valve 44 engages the decreasing radius ramp portion 36*b*, then the smaller radius valve open portion 36*c*. Edge 44*a* of the valve 44 is fixed at a substantially constant radius from the center of the cylinder 212 due to the valve hinge mechanism 50 and the movement of cam follower mechanism 58 within cam channels 36. However, edge 44*b* of valve 44 is forced to open toward the center of the cylinder 212 as the actuating mechanism 58 reaches the smaller radius portion 36*c* of the cam channel 36. This edge of the valve rotates about the hinge mechanism 50. Thus, when valve 44 is forced open by rotation of the outer cylinder and corresponding movement of the actuating aims along the cam channels, movement of the opposed pistons toward each other causes combustion products to be ejected from opening 212*b* into the exhaust runner. As the piston caps 124 and 134 of the pistons reach top dead center, the valve mechanism associated with aperture 210*b* closes, allowing a new cycle to begin.

In other alternative embodiments, types of valves other than the type described above may be employed. For example, spring-loaded poppet valves may be used. These valves may be actuated as previously described, by engagement between cam channels formed in a rotating outer cylinder and actuating members, or by other features formed on the valves.

A glow plug or other chamber heating mechanism may be incorporated into the assembly to heat the combustion chamber, if desired. The engine may also incorporate an electronic control module (ECM) and associated sensors, as know in the art, to perform and/or facilitate engine control functions.

In another embodiment of the present invention, the engine structure described herein is adapted to execute a two-stroke diesel engine cycle. In one example of such a cycle, at the point of closest approach of the opposed pistons to each other, the cylinder contains a volume of highly compressed air. Diesel fuel is injected into the cylinder by the injector and the fuel immediately ignites because of the pressure and heat inside the cylinder. Expanding gases due to combustion of the fuel drive the opposed pistons apart. This is the power stroke of the engine.

As the opposed pistons near the "bottoms" of their respective strokes (i.e., when the spacing between the opposed pistons nears its greatest extent), sleeve 912' (see FIGS. 6 and 7) has rotated to a point where engagement between cam channel 36 and exhaust valve 44 has opened the exhaust valve, permitting the pressurized gases to exit the cylinder and relieving the pressure within the cylinder.

When the spacing between the opposed pistons reaches its greatest extent, sleeve 912' has rotated to a point where engagement between cam channel 36 and intake valve 42 has opened the intake valve, permitting pressurized air to fill the cylinder and forcing the remainder of the exhaust gases from the cylinder. Sleeve 912' then continues to rotate to a point where engagement between cam channel 36 and exhaust valve 44 closes and the pistons start traveling back toward each other and compressing the newly received charge of air. This is the compression stroke of the engine. As the pistons approach each other, the cycle repeats.

From the above description, it can be seen that interaction between the rotating sleeve and cam channel and the cam follower mechanism can be adjusted to execute a two-stroke diesel engine cycle.

Figure 8:
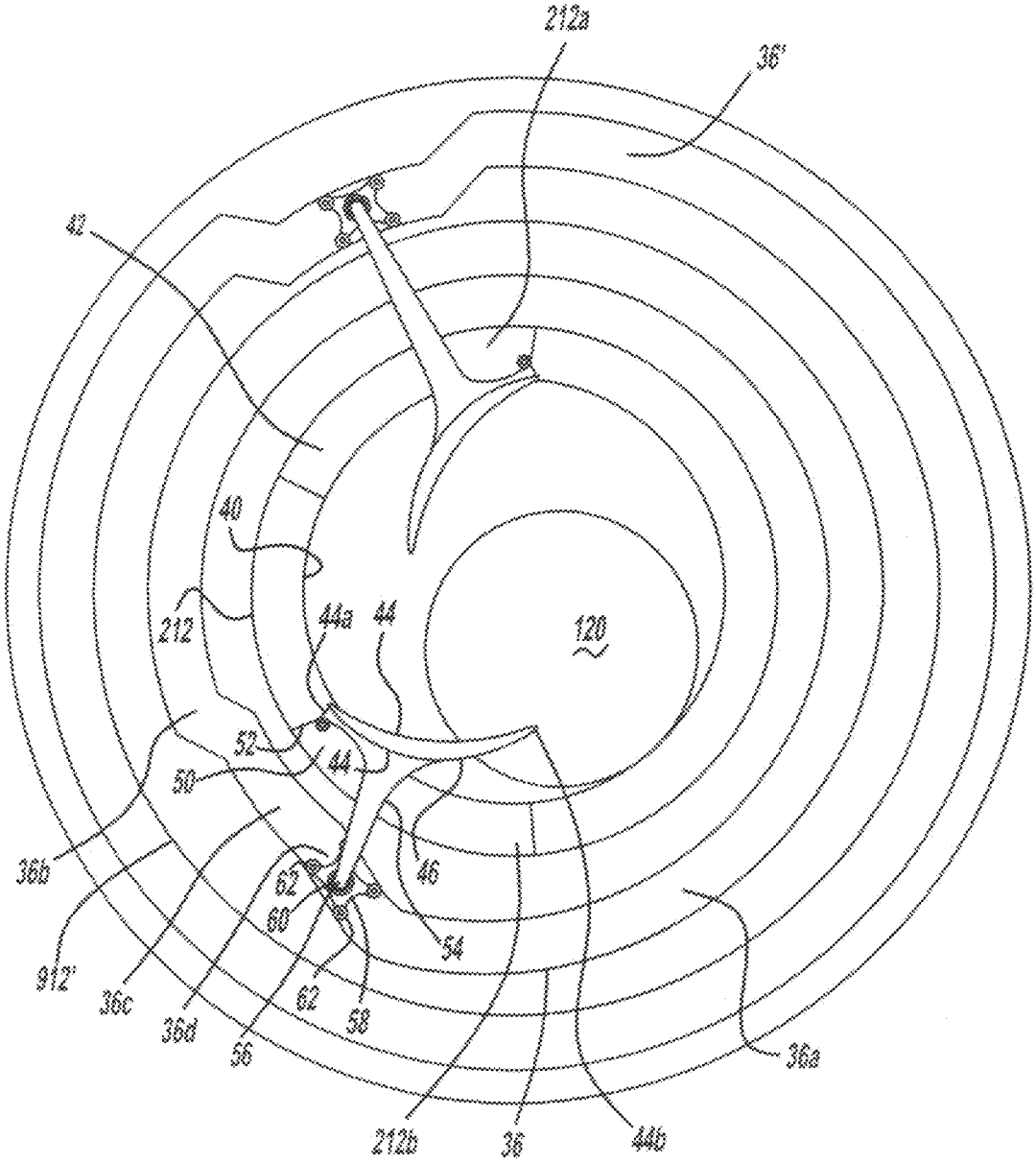
FIG. 8 is a cross-sectional view across a single combustion chamber of an alternative embodiment of the engine.

In another embodiment, greater flexibility of control over actuation of the valves is provided by adding to each sleeve another, separate cam channel 36' radially outboard of cam channel 36, as shown in FIG. 8. In this embodiment, different cam channels 36 and 36' engage respective ones of valves 42 and 44 so that actuation of each valve becomes independent of the cam channel controlling actuation of the other valve. This enables, for example, the simultaneous opening and closing of the valves while also enabling the valves to remain open or closed for different, independent lengths of time. This would help facilitate, for example, closing of both intake valve 42 and exhaust valve 44 in rapid succession independent of the respective cam channel configurations.

In order to accommodate one or more additional cam channels, the outer diameters of sleeves 912 and 912' may need to be greater than in sleeves incorporating only a single cam channel. The engine block may be designed to accommodate the larger diameter sleeves. Then, in instances where only a single cam channel is to be employed, one or more annular spacers (not shown) may be attached to the smaller diameter sleeves along outer surfaces thereof to occupy the space in the engine block that would otherwise be occupied by the larger diameter sleeves. Sleeve bearings or other bearings may be positioned between the spacers and the engine block to facilitate rotation between the spacers and the engine block.

Figure 9:
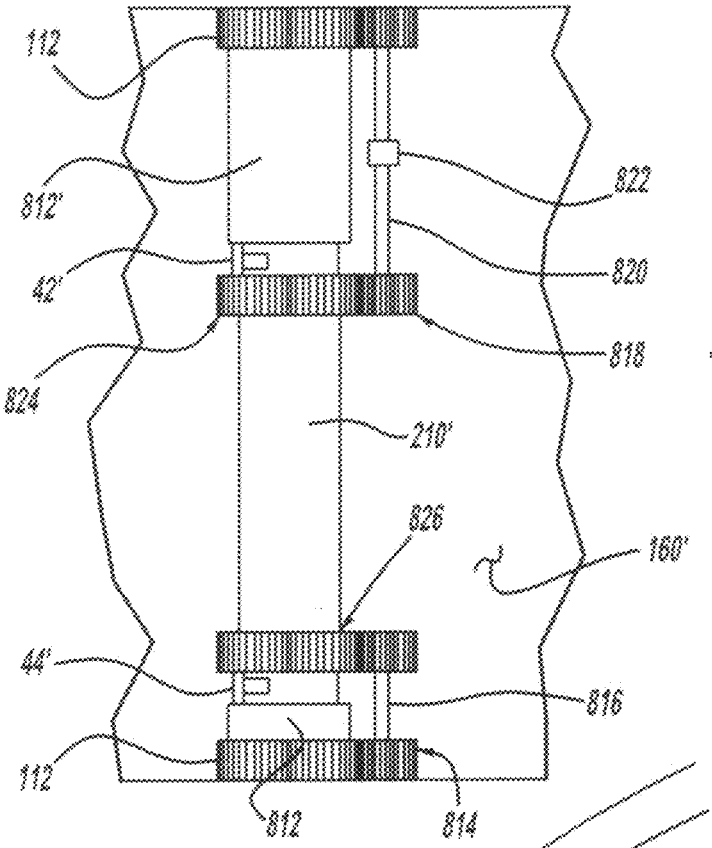
FIG. 9 is a cross-sectional view an exemplary cylinder and sleeve arrangement of an opposed piston diesel engine in accordance with an alternative embodiment of the present invention.

Referring to FIG. 9, in yet another embodiment, independent control of valves 42' and 44' is provided by forming cam channels in sleeves 812 and 812' as previously described, and by coupling a pair of secondary gear trains 818 and 814 to gears 112 (previously described and shown in FIG. 1). Sleeves 812 and 812' are rotatably mounted on cylinder 210' as previously described. Also, geared sleeves 824 and 826 are rotatably mounted on cylinder 210' as previously described. Sleeves 812 and 812' are coupled to gears 112 as previously described to rotate the cam channels mounted in the sleeves. Secondary gear trains 818 and 814 are positioned in cylinder case 160 in a known manner.

Gear trains 818 and 814 transfer rotational motion of main gears 112 to respective ones of geared sleeves 824 and 826, which have cam channels formed therein that are complementary to the cam channels formed in sleeves 812 and 812'. Thus, valve 44' is actuated in the manner previously described by the movement of its cam follower mechanism along complementary cam channels formed in sleeve 812 and geared sleeve 826, while valve 42' is actuated by the movement of its cam follower mechanism along complementary cam channels formed in sleeve 812' and geared sleeve 824, Geared sleeve 824 is geared to rotate (via secondary gear train 818) in conjunction with an associated gear 112 and its associated sleeve 812' to control rotation of the sleeves 812' and 824 such that the complementary cam channels formed in sleeves 812' and 824 operate in conjunction with each other to actuate valve 42' in the manner previously described. Similarly, geared sleeve 826 is geared to rotate (via secondary gear train 814) in conjunction with an associated gear 112 and its associated sleeve 812 to control rotation of the sleeves 812 and 826 such that the complementary cam channels formed in sleeves 812 and 826 operate in conjunction with each other to actuate valve 42 in the manner previously described.

One or more intermediate bearings 822 may be provided along the shafts connecting the gears of the secondary gear trains, for supporting the shafts. This arrangement enables independent control of valves 42' and 44' while also enabling positioning of the valves anywhere along substantially the entire length of the cylinder 210'. This flexible positionability provides additional control over the engine cycle.

In the two-stroke cycle embodiments described above, a turbocharger or a supercharger may be coupled to the engine for compressing the intake air in a known manner.

Figure 10A:
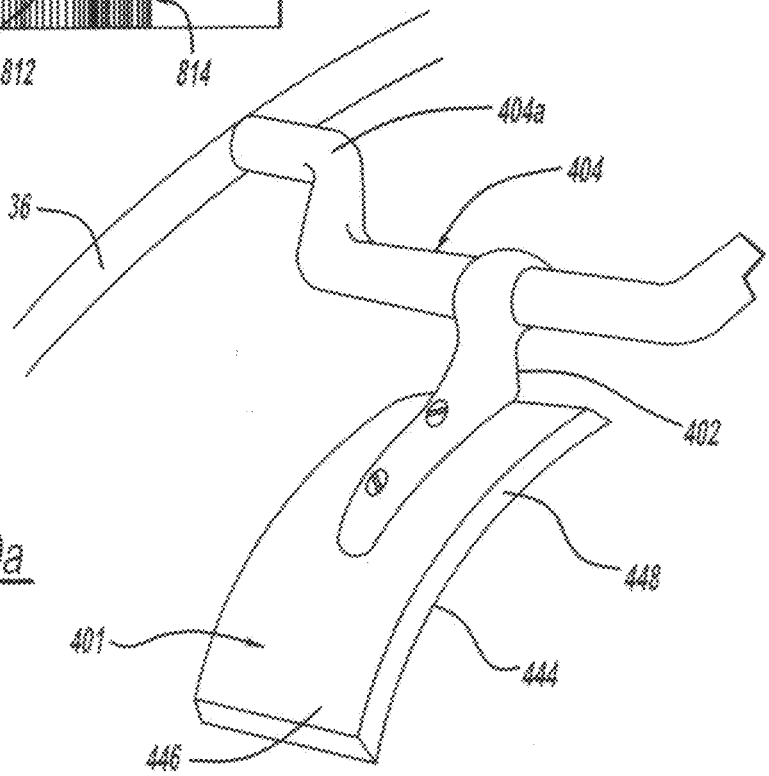
FIGS. 10*a*-10*b* show views of a valve mechanism in accordance with an alternative embodiment of the present invention.
Figure 10B:
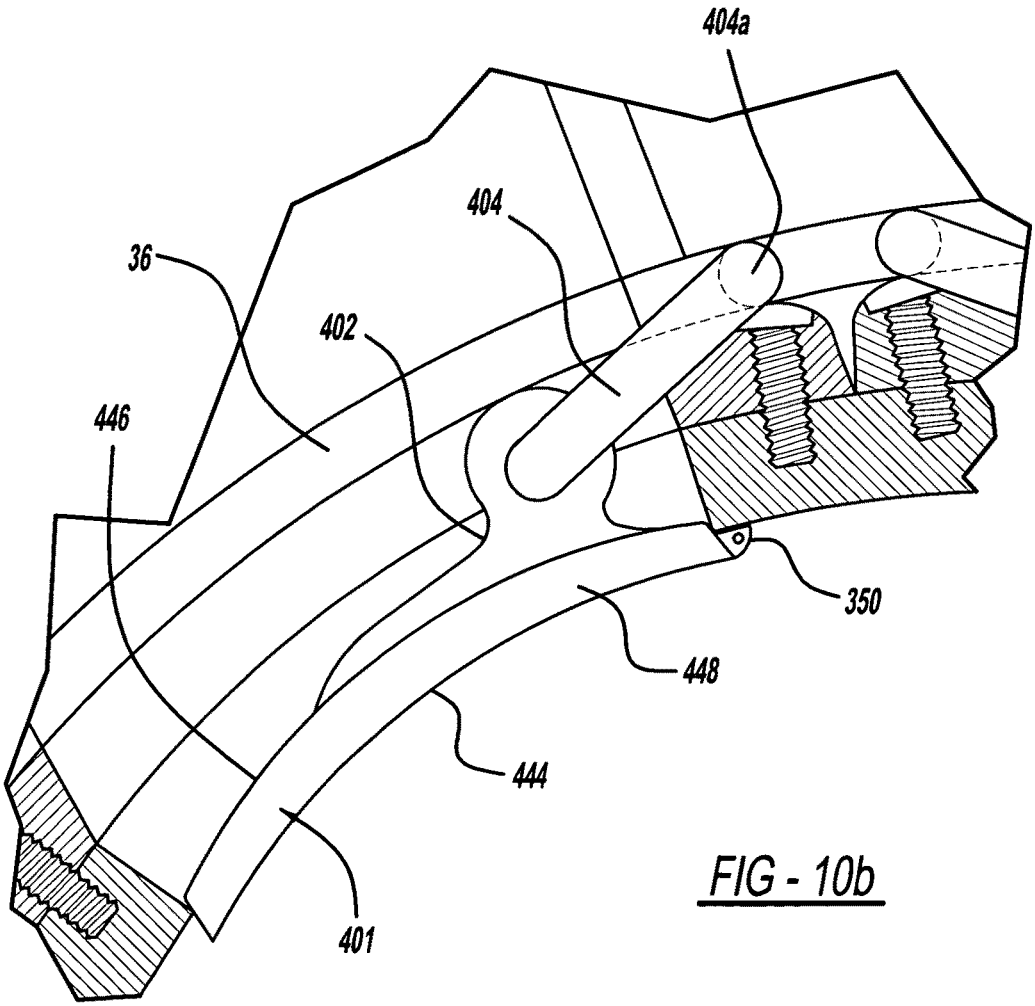

Referring now to FIGS. 10*a*-10*b*, another embodiment of the valve includes a curved plate 401 including a combustion chamber face 444, a back 446 opposite the face 444, and a sealing periphery 448 as previously described. A connector 402 is attached to plate 401, and an actuating member 404 is attached to connector 402.

In the embodiment shown, the orientation of actuating member 404 is fixed with respect to plate 401 such that the entire sub-assembly comprising plate 401, connector 402, and actuating member 404 is rotatable as a unit. In a particular embodiment, connector 402 and actuating member 404 are formed as a single piece.

Referring to FIGS. 10*a*-10*b*, an arm 404*a* formed on each end portion of actuating member 404 moves within in a respective cam channel 36 of a corresponding one of rotating sleeves 912, 912' during rotation of the sleeves, in a manner similar to that previously described for cam follower mechanism 58. Lubrication may be provided to facilitate relative motion between the cam channel surfaces and the aims 404*a*. Any of a number of suitable lubricating mechanisms may be used, for example, graphite impregnation of the arms and/or the cam channels, application of oils or other viscous lubricants, or other lubricating methods may be used.

In another embodiment (not shown), connector 402 is rotatable with respect to actuating member 404 (i.e., the actuating member is mounted within and can rotate within connector 402).

In the embodiment shown in FIGS. 10*a*-10*b*, an edge of plate 401 is pivotably attached to a hinge mechanism 350 similar to hinge mechanism 50 previously described. Plate 401 rotates about hinge mechanism 350 during actuation of the valve to open and close the valve, as previously described.

In another embodiment (not shown), a portion of plate 401 abut or engages an edge of cylinder aperture 210*a* (or 210*b*) or an inner surface of the cylinder to form a pivot point for the plate 401 at the point of contact between the plate and the cylinder. Actuation of the valve by motion of actuating member 404 resulting from rotation of the sleeves 912, 912' produces rotation of the plate 401 about the pivot point, to open and close the valve.

Actuation of the valve embodiment shown in FIGS. 10*a*-10*b* is similar to actuation of the embodiment shown in FIGS. 4-7. As sleeves 912, 912' rotate, arms 404*a* on actuating member 404 ride within respective cam channels 36, producing motion of the actuating arm and a corresponding rotation of plate 401, to open and close the valve.

In yet another embodiment (not shown), a pivot member is provided intermediate the actuating member 404 and plate 401. The pivot member, actuating member, and plate are coupled together so as to form a substantially rigid member. The pivot member is coupled to the cylinder so as to permit rotation of the rigid member about the pivot member and with respect to the cylinder. In this embodiment, engagement between the actuating member and the cam channel surfaces produces rotation of the rigid member (including the plate 401 seated in the valve aperture) about the pivoting member, to open and close the valve.

In other alternative embodiments, types of valves other than the type described above may be employed. For example, spring-loaded poppet valves may be used. These valves may be actuated as previously described, by engagement between cam channels formed in a rotating outer cylinder and actuating members, or by other features formed on the valves.

The engine may also incorporate an electronic control module (ECM) and associated sensors, as know in the art, to perform and/or facilitate engine control functions.

FIGS. 11-14*b* show a cylinder assembly 1100 incorporated into an opposed piston diesel engine including a valve system in accordance with another embodiment of the present invention. The cylinder assembly embodiment 1100 shown in FIGS. 11-14*b* is a four-cycle or four-stroke engine as previously described and while it is illustrated with a single cylinder 1210, it will be understood in view of the previously described embodiments that the structure and operating principles shown in FIGS. 11-14*b* may be applied to any number of cylinders depending on the amount of power desired to be produced by the engine. In addition, the structural arrangements and operating principles described herein may alternatively be applied to a two-stroke engine.

Figure 11:
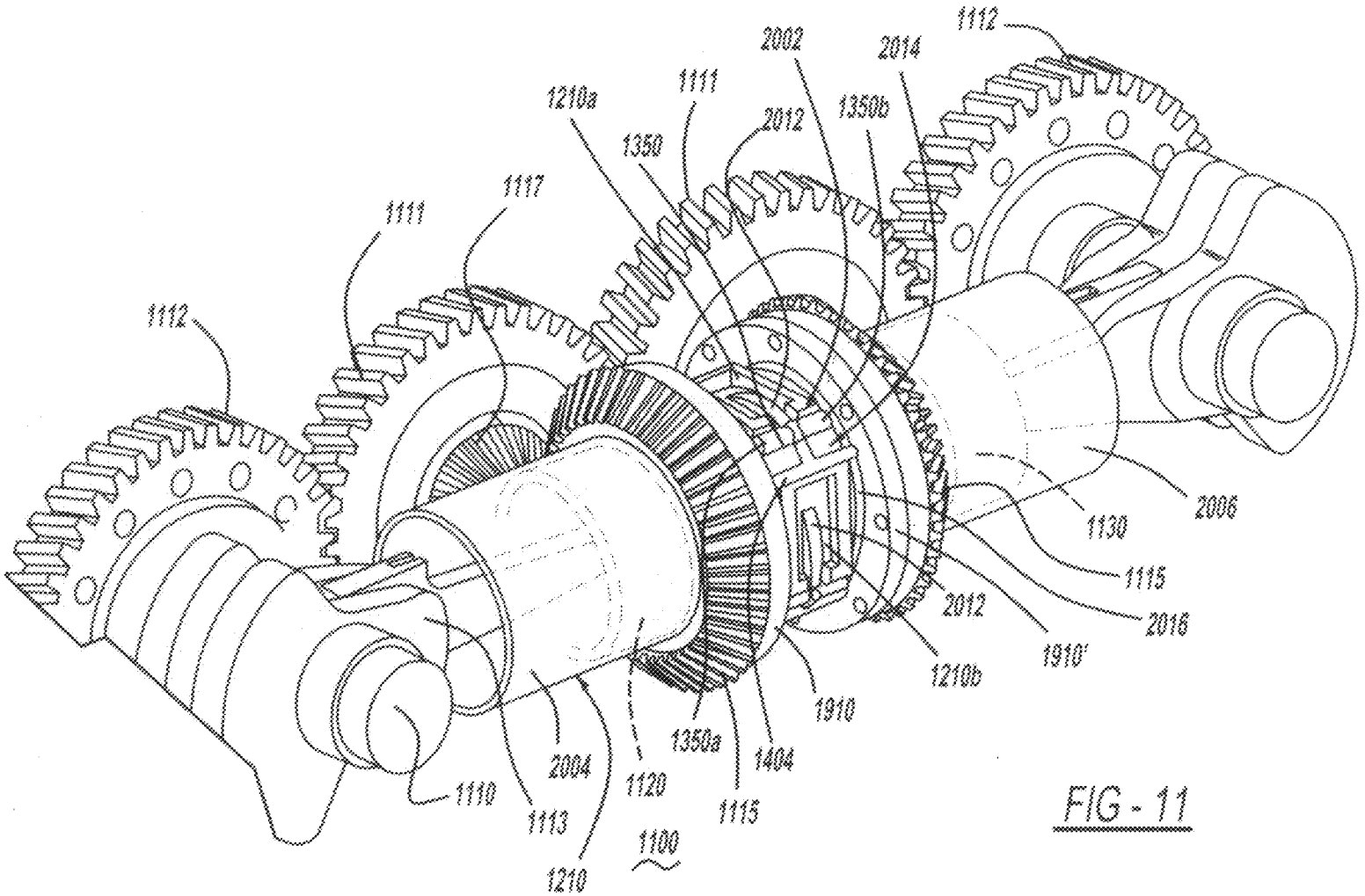
FIG. 11 is a perspective view of a diesel engine cylinder assembly incorporating a valve mechanism in accordance with another embodiment of the present invention.

Referring to FIG. 11, each cylinder 1210 of the engine forms (in conjunction with opposed pistons 1120 and 1130 disposed within the cylinder) a combustion chamber for the air-fuel combustion reaction. In the embodiment shown in FIGS. 11-14*b*, each cylinder is associated with a respective pair of rotating outer sleeves 1910, 1910', (e.g., sleeves 1910 and 1910' are rotatably coupled to cylinder 1210 in FIG. 1 along an exterior thereof). FIG. 11 shows rotating sleeves 1910, 1910' associated with cylinder 1210. An engine block or cylinder case (not shown) of the engine encloses the cylinder assemblies and opposed pistons as previously described. Each sleeve has one or more camming surfaces formed therealong for purposes described in greater detail below. Each cylinder is also associated with a pair of connecting rods 1110, a pair of gears 1112, each being gear connected to an associated one of rods 1110, opposing first and second pistons 1120 and 1130 that are each interconnected with a connecting rod 1113, first and second opposing piston caps (not shown) as previously described, and a pair of bearing caps (not shown) as previously described. Optional first and second opposing cylindrical spacers as previously described (not shown) may be affixed to respective ones of the opposed pistons for purposes described below.

In the embodiment shown in FIGS. 11-14*b*, a bevel gear 1115 is attached to an end of an associated one of rotating sleeves 1910, 1910' and is driven by an mating bevel gear 1117 mounted concentrically with another gear 1111 which is driven by a associated one of gears 1112. In the embodiment shown in FIGS. 11-14*b* the rotational axes of gears 1111/1117 and gears 1112 are substantially parallel; however, other arrangements are also possible. Rotation of bevel gears 1117 produces rotation of mating bevel gears 1115, thereby producing rotation of the sleeves 1910, 1910' attached to the gears 1115. Each associated crankshaft is configured to provide predetermined stroke lengths to the first and second pistons 1120 and 1130 residing within each cylinder, as previously described. The opposed first and second pistons 1120 and 1130 may be of a relatively standard design, and have predetermined lengths and predetermined diameters.

Figure 12:
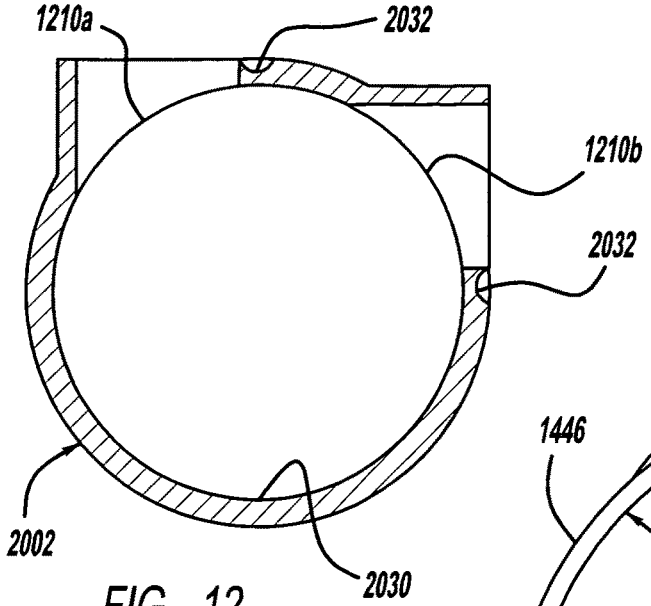
FIG. 12 is a cross-sectional view of a portion of a valve block incorporated in the embodiment shown in FIG. 11.
Figure 13:
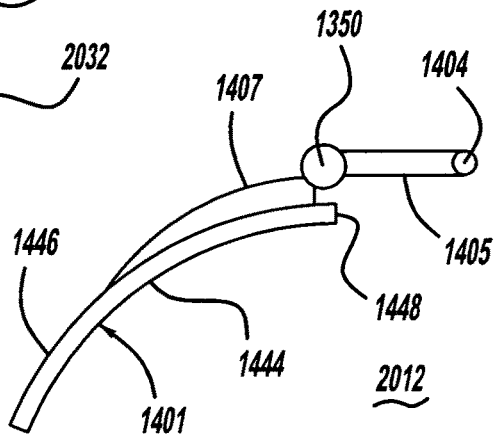
FIG. 13 is a side view of a valve incorporated in the embodiment shown in FIG. 11.

Cylinder 1210 resides within respective outer sleeves 1910, 1910', as shown in FIGS. 11 and 12. Cylinder 1210 is also stationary with respect to the rotating sleeves. The gears 1112, through rotation of associated gears 1111 and 1117, are configured to rotate each associated sleeve at a speed of one half crank speed, and each sleeve has a predetermined length. The sleeves of each pair of sleeves associated with an individual cylinder rotate in conjunction with each other, at the same speed and in the same direction. Sleeve or plain bearings (not shown) or any other suitable bearings may be positioned between the cylinders and their respective sleeves to facilitate rotation of the sleeves with respect to the cylinders. Similarly, if desired sleeve or plain bearings (not shown) or any other suitable bearings may be positioned between the rotating sleeves and the engine block (not shown) to facilitate rotation of the sleeves with respect to the engine block. One source of suitable bearings for this application is GGB Bearings of Thorofare, N.J.

Referring to the arrangement within cylinder 1210 of FIG. 11 as exemplary, optional first and second cylindrical spacers (not shown) as previously described may be affixed to the face of the associated pistons 1120 and 1130. The optional spacers are not necessary but may be utilized to provide correct piston lengths for controlling spacing between the piston faces, thereby providing a means for adjusting the compression ratio and generally providing a predetermined degree of compression for heating intake air to facilitate combustion of a fuel injected or otherwise inserted into the combustion chamber. As with the previously described embodiments, the piston lengths are geometrically determined in accordance with the piston stroke length and the lengths of apertures 12010*a* and 1210*b* (described below) formed in the cylinders through which flow exhaust gases and air for combustion.

Referring again to cylinder 1210 of FIGS. 11-14*b*, first and second piston caps (not shown) as previously described may be attached to faces of associated ones of pistons 1120 and 1130 (or to associated optional cylindrical spacers in an embodiment where spacers are used). As previously described, the piston caps may be formed from a sandwich of two sheets of carbon fiber with a ceramic center. The piston caps which are exposed to the combustion event may be slightly concave in form so that when the two piston caps meet in the center of the cylinder they form a somewhat spherical combustion chamber. Only the ceramic cores of the piston caps may actually come into contact with the stationary cylinder wall.

Each piston should have a length from the tire ring to the cap suitable for keeping the piston rings out of the apertures formed in the cylinders. The optional spacers and piston caps may each have a diameter roughly equal to the interior diameter of the associated cylinder, and may be made of carbon fiber, ceramic, or any other suitable material to aid in minimizing thermal inefficiencies during engine operation. The valve mechanism embodiment and associated elements shown in FIGS. 11-14*b* can operate in an engine block similar to block 160 shown in FIG. 3, in a manner similar to that previously described.

As in previously described embodiments, each of cylinder apertures 1210*a* and 1210*b* is associated with a respective valve mechanism which is actuated responsive to the portion (i.e., intake, compression, power, or exhaust) of the engine cycle occurring in the cylinder at any given moment, as described in further detail below. The cylinder valve mechanism opens to admit air into the interior of cylinder 1210 for compression by pistons 1120 and 1130, and also opens to eject combustion exhaust from the cylinder interior after combustion has taken place. In addition, in the manner described below, cam surfaces residing on associated sleeves 1910 and 1910' actuate the valve mechanisms associated with each of apertures 1210*a* and 1210*b*.

The cam surfaces include any surface that engages an actuating portion of the valve to produce rotation of at least a portion of the valve. Thus, the cam channels shown in FIGS. 6-8 have opposed walls, both of which function as cam surfaces because each of the opposed walls engages a portion of the valve to produce valve rotation. Similarly, in other embodiments described herein, rotation of the valve may be produced by engagement between a potion of the valve and a single cam surface or a cam surface without an opposed wall extending therealong.

In the embodiment shown in FIGS. 11-14*b*, the valve mechanism essentially comprises a single poppet type valve opening into the common combustion chamber between the two opposed pistons in each cylinder pair. As in the previously described embodiments, the engine configuration to which the poppet valve mechanism is adapted includes a valve rotatably coupled to the stationary cylinder, and the rotating sleeves surrounding each cylinder. The valve is pivotally coupled to the associated cylinder and is actuated by an arm or arms formed on (or coupled to) an actuator or guide which slides along one or more cam surfaces provided on an associated one of sleeves 1910 and 1910'.

As in the previously described embodiments, the engine and valve system operate by gearing or otherwise driving the rotation of the sleeves to correspond with the reciprocation of the pistons of each pair. The cylinder valve apertures or ports 1210*a* and 1210*b* extend about a portion of the periphery thereof and are aligned with intake and exhaust runners as previously described, with a single valve disposed across or over each port. As the sleeves rotate about the cylinders, guides attached to the valve actuation arms ride along the cam surfaces or tracks formed in the sleeves. The contours of the cam surfaces or track(s) vary in height or radial distance from the center of the cylinder in their path(s) about the cylinder. As the valve actuators or guides travel along the variable radius cam surfaces or channels, the seatable portion of the valve is periodically pushed inwardly toward the center of the cylinder to open the valve port, and alternately lifted away from the inward position to close the valve port of the cylinder. The opening and closing of the valve port permits inflow of intake charges and outflow of exhaust gases from the combustion chamber.

Details of the structure and operation of the valve mechanisms shown in 11-14*b* are now described.

Referring to FIGS. 11-14*b*, cylinder 1210 has a pair of apertures or valve ports 1210*a* and 1210*b* formed therealong and positioned so as to enable fluid communication between an interior of the cylinder and the associated intake and exhaust runners formed in an engine block (not shown). Only the apertures formed along a single cylinder 1210 will be described for simplicity. However, it will be understood that any additional cylinders would incorporate similar features arranged so as to facilitate execution of the diesel engine cycle described herein.

In the embodiment shown in FIGS. 11-14*b*, a portion of cylinder 1210 is formed by a valve block 2002 interposed between, and connected to, first and second cylinder portions 2004 and 2006. The valve block contains the cylinder apertures 1210*a* and 1210*b* and provides a mounting structure for the valves. The valve block 2002 may be welded or otherwise connected to cylinder portions 2004 and 2006 so as to form substantially gas tight seals between the valve block and cylinder portions. The cylinder portions and valve block combine to form the cylinder 2001 in which the pistons 1120 and 1130 reciprocate and in which the fuel is burned.

Valve block 2002 defines an interior 2008 which forms at least a portion of the cylinder combustion chamber, and a pair of apertures 1210*a* and 1210*b* through which exhaust gases and air for combustion flow into the combustion chamber. Pistons 1120 and 1130 reach the apexes of their respective strokes in the valve block interior.

An interior surface 2030 of the valve block 2002 may have a diameter substantially equal to the inner diameter of cylinder portions 2004 and 2006, to provide piston guide surfaces within the valve block that are continuous with the inner surfaces of cylinder portions 2004 and 2006. This permits the pistons to approach each other as closely as possible, enabling greater control of the piston stroke length and compression ratio. The valve block may also contain grooves or other suitable seating features 2032 for receiving therein a pivot portion 1350 of an associated valve (described in greater detail below). The valve block may be cast and finished machined or fabricated using any other suitable techniques.

Valves 2012 are operatively coupled to valve block 2002 for controlling entry of air into the cylinder and exit of exhaust gases from the cylinder according to the requirements of the engine cycle, as previously described. In the embodiment shown in FIGS. 11-14*b*, and with reference to FIG. 13 in particular, each of valves 2012 includes a curved plate 1401 having a combustion chamber face 1444, a back 1446 opposite the face 1444, and a sealing periphery 1448 as previously described with regard to other valve embodiments. A stern 1407 connects plate 1401 to a pivot portion 1350 which is pivotably coupled to valve block 2002. Another stem 1405 connects pivot portion 1350 to a guide or actuator portion 1404 which slides along a cam surface 2016 residing on an associated sleeve, in the manner previously described. In the embodiment shown, valve 2012 is structured so that plate 1401, stem 1407, pivot portion 1350, stem 1405, and actuator 1404 are rotatable or pivotably as a unit about pivot portion 1350. In a particular embodiment, these elements of valve 2012 are formed as a single piece. Pivot portion 1350 may be rotatably positioned in a groove or other locating feature 2032 formed in valve block 2002. The valve block 2002 with the valves 2012 rotatably mounted thereon combine to form a valve module, generally designated 2014.

In a particular embodiment, only one rotating sleeve is coupled to the cylinder to actuate the valve.

In addition, the faces of pistons 1120 and 1130 may be provided with recesses configured to receive curved plate 1401 therein during the apexes of the piston strokes. This permits the valve to be in an open position when the pistons are at or near apexes of their strokes, thereby permitting additional flexibility with regard to compression ratios and engine cycle control.

In one particular embodiment, actuator or guide portion 1404 rides along a cam channel or track (not shown) provided in sleeve 1910. These cam channels may be similar to the cam channels shown in FIGS. 6-8 as previously described. A valve block groove 2032 in which the pivot portion 1350 is seated may be configured, in conjunction with the reaction forces on the actuator portion 1404 produced by the opposed walls of the cam channel, to keep the pivot portion 1350 seated in the groove during operation of the valve. Alternatively, the pivot portion 1350 may be secured in the groove or other locating feature by one or more retention features or devices applied proximate the opposed ends 1350*a*, 1350*b* of the pivot portion to rotatably secure the pivot portion to the valve block.

In the embodiment shown in FIGS. 11-14*b*, a single cam surface 2016 is formed along the sleeve rather than a cam channel having opposed sides. The valve may be spring loaded to bias the valve toward the closed position, as described below.

FIG. 15 shows a sleeve 1910' in accordance with an embodiment of the present invention. Sleeve 1910' has a central opening 1911' dimensioned to have a diameter substantially equal to an inner diameter of associated cylinder portion 2006 (see FIG. 11), to effectively serve as an extension of the cylinder portion for receiving cam 1130 therein during operation of the engine. Cam surface 2016 is formed along the sleeve and includes associated ramps 2017 to provide initial and terminal engagement between the cam surface and the valve actuator 1404 (not shown) during rotation of the sleeve 1910'. As the sleeve rotates, the actuator contacts a ramp 2017 and slides along the ramp, initiating rotation of the valve 2012. When the actuator reaches the radially outermost position 2016*a* of the cam surface, the valve is at maximum rotation in the fully open position.

In a particular embodiment, the valve is biased in the closed position using a spring or other mechanism as described herein, and the actuator is engaged by the cam surface only at a point in the cycle when it is desired to rotate the valve to an open position, and for an amount of time sufficient to hold the valve open for the intake or exhaust segment of the cycle. This minimizes the amount of time the actuator is in contact with the cam surfaces, thereby reducing friction and wear on the mechanism.

The valve 2012 may be biased to the closed position using a cantilever spring, torsion spring, or other suitable type of spring (not shown). Then sliding motion of the valve actuator 1404 along the sleeve cam surface 2016 forces the valve into an open configuration against the forces exerted by the spring.

When the cam surface rotates further and disengages from the valve actuator, the spring urges the valve back into a closed position.

The cam surfaces formed along the sleeves can be configured to engage the valve to open the valve, to close the valve, or both. Where engagement with the cam surfaces is used only to open the valve, the valve may be biased in a closed position using spring loading or another suitable method, as described above.

The cylinder and associated valve assembly shown in FIGS. 11 and 12 may be assembled by attaching cylinder portions 2004 and 2006 to valve block 2002 as previously described. Valves 2012 are then mounted on the valve block so as to enable operation of the valves to open and close cylinder apertures 1210*a* and 1210*b*. Sleeves 1910, 1910' and their associated bevel gears 1115 are then applied and secured to the outer surfaces of the cylinder portions. Alternatively, sleeves 1910, 1910' and their associated bevel gears 1115 may be applied and secured to the outer surfaces of the cylinder portions prior to attachment of the cylinder portions to the valve block.

Figure 14A:
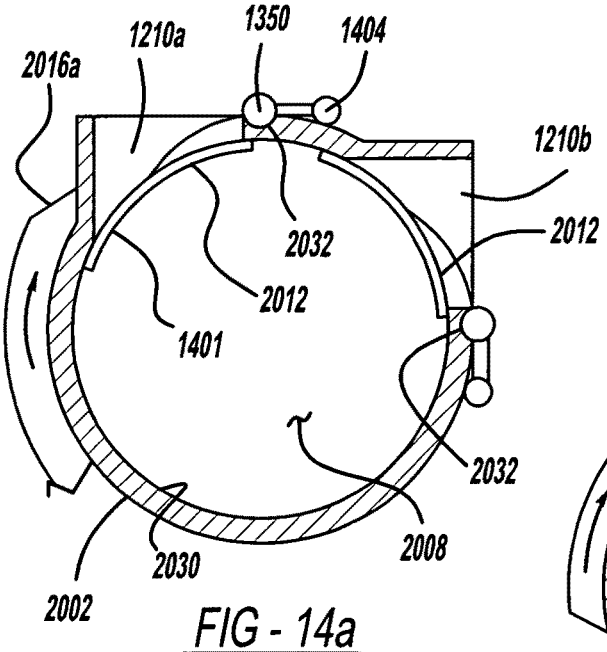
FIGS. 14*a* and 14*b* are cross-sectional views of a portion of the cylinder assembly shown in FIG. 11, showing operation of one of the valves incorporated therein.
Figure 14B:
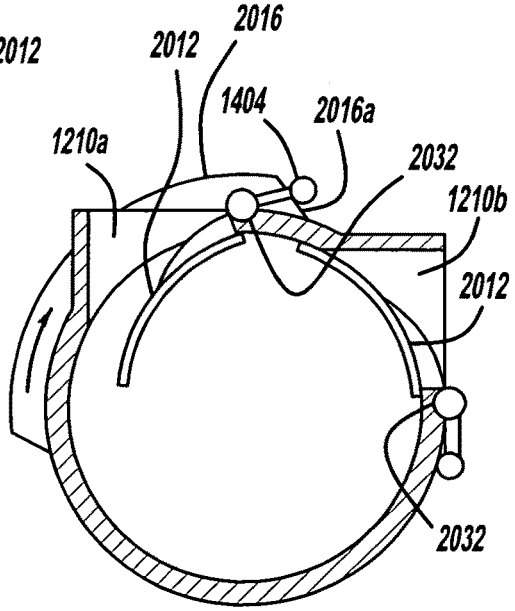

Referring to FIGS. 11-14*b*, during operation, rotation of sleeve 1910 produces sliding motion between actuator 1404 and cam surface 2016. FIGS. 14*a* and 14*b* show a cross section of the arrangement of FIGS. 11-13 prior to engagement between cam surface 2016 and actuator 1404 (FIG. 14*a*) and after engagement between cam surface 2016 and actuator 1404 (FIG. 14*b*). The arrow on cam surface 2016 shows the direction of rotation of the cam surface with respect to the valve 2012. Engagement and disengagement between the cam surface and the actuator as the cam surface rotates causes the valve 2012 to rotate about pivot portion 1350 to force the sealing periphery 1448 radially inwardly (and, optionally, outwardly) with respect to the central axis of the cylinder. This engages and disengages the sealing periphery 1448 of the valve from the edges of aperture 1210*a*, thereby opening and closing the valve in accordance with the desired engine cycle, as previously described.

Lubrication may be provided to facilitate relative motion between the cam surfaces and the actuator 1404. Any of a number of suitable lubricating mechanisms may be used. For example, graphite impregnation of the actuator and/or the cam surfaces, application of oils or other viscous lubricants, or other lubricating methods may be used.

The engine may also incorporate an electronic control module (ECM) and associated sensors, as know in the art, to perform and/or facilitate engine control functions.

Also, as previously described herein, each of valves 2012 may be actuated by one or more separate cam surfaces configured for controlling the particular valve. The separate cam surfaces configured for controlling the separate valves may be formed on the same sleeve as previously described with regard to FIG. 8. Alternatively, the separate cam surfaces may be formed on separate sleeves as previously described with regard to FIG. 9.

In the embodiments shown in FIG. 6 and in FIGS. 11-15, a single set of cam surfaces is used to actuate both of valves 42 and 44. FIGS. 16*a* and 16*b* show a sleeve 2910' in accordance with an alternative embodiment of the present invention. Sleeve 2910' has a central opening 2911' dimensioned to have a diameter substantially equal to an inner diameter of associated cylinder portion 2006 (see FIG. 11), to effectively serve as an extension of the cylinder portion for receiving cam 1130 therein during operation of the engine. A first cam surface 2016 is formed along the sleeve and includes associated ramps 2017 to provide initial and terminal engagement between the cam surface and a first valve actuator 1404*a* during rotation of the sleeve 2910'. In addition, a second cam surface 3016 is formed along the sleeve and includes associated ramps 3017 to provide initial and terminal engagement between the cam surface and a second valve actuator 1404*b* during rotation of the sleeve 2910'. Second cam surface 3016 is spaced radially outwardly from first cam surface 2016.

When the second valve is mounted on the valve block or cylinder, the radial distance of the second valve actuator 1404*b* from the cylinder center is relatively greater than the radial distance of the first valve actuator 1404*a* from the cylinder center, to enable the second valve actuator to engage radially outermost cam surface 3106. FIGS. 17*a*-17*b* show various embodiments of the valve in which the radial distance of the actuator portion 1404*b* is greater than the radial distance of the actuator 1404 shown in the valve embodiment shown in FIG. 13, when the valve is mounted on the valve block or cylinder. Also, as seen in FIG. 16*b*, the width "B" of the second actuating portion 1404*a* (taken parallel with the axis of the cylinder) is relatively greater than the width "A" of the first actuating portion 1404*a*.

In combination, the radial spacing apart of the cam surfaces 2016 and 3016 and the location of the second actuating portion 1404*b* at a greater distance from the cylinder center than first actuating portion 1404*a* ensure that only first cam surface 2016 engages first actuating portion 1404*a* and only second cam surface 3016 engages second actuating portion 1404*b*. In this manner, sleeve 2910' is configured to enable independent control of the valves 2012 as previously described in the portion of the specification relating to FIG. 8. That is, instead of both valves being controlled by the same cam surface (or the same group of cam surfaces formed along a single cam ring), each valve is controlled by its own separate cam surface (or group of cam surfaces).

In another embodiment, instead of mirror-imaged cam surfaces formed along opposed sleeves (such as sleeves 1910 and 1910' in FIG. 11) for actuating the valves 2012, each sleeve may have one or more cam surfaces shaped differently from the cam surface(s) on the opposite sleeve. The locations of the cam surfaces on the sleeves, the radial distances of the valve actuating portions of the valves from the cylinder center, and the widths of the actuating portions may be adjusted as previously described so that a first valve is actuated by a cam surface a first one of sleeves, and a second valve is actuated by the other one of opposed sleeves 1115. In this manner, the sleeves are configured to enable independent control of the valves 2012 as previously described.

In a particular embodiment, additional flexibility of control over the engine cycle may be provided by suitably controlling the gear reductions through gears 1111, 1117, and 1115 so that the sleeves (such as sleeves 1910 and 1910' in FIG. 11) rotate at different rates. This configuration may be combined with the previously described control of separate valves by cam surfaces formed on different sleeves to increase flexibility of engine cycle control.

In addition, any desired number of valves may be mounted on the valve block or cylinder and actuated using one of the methods described herein, depending on the space available for mounting and actuation of the valves.

In another embodiment, the cylinder is a conventional cylinder with a pair of apertures formed therein as previously described, to permit the passage of air and exhaust gases into and out of the cylinder interior. The cylinder may be a single piece. The valve block is a separate piece (or pieces) on which the valves can be rotatably mounted, and which is secured to or about an outer surface of the cylinder in a position enabling valves mounted on the valve block to open and close the cylinder apertures, as previously described.

Alternatively, a valve as shown in FIGS. 11-14*b* may be rotatably secured directly to a cylinder proximate one of the cylinder apertures so as to ensure operation of the valve in accordance with the engine cycle, as previously described. The cylinder may be a single piece. A seat for pivot portion 1350 be formed along (or attached to) an outer surface of the cylinder, and the valve mounted thereon via the pivot portion. The valve may be spring loaded as previously described, and is actuated by engagement with cam channels or cam surfaces formed on rotating sleeves which engage actuating portions of the valve, as previously described.

It will be understood that the foregoing descriptions of the embodiments of the present invention are for illustrative purposes only, and that the various structural and operational features herein disclosed are susceptible to a number of modifications, none of which departs from the spirit and scope of the present invention. The preceding description, therefore, is not meant to limit the scope of the invention. Rather, the scope of the invention is to be determined only by the appended claims and their equivalents.

What is claimed is:

1. A valve mechanism comprising:

a valve structured to be operatively coupled to a non-rotating engine cylinder, so as to be rotatable to a first orientation to seal an opening formed in the cylinder, and so as to be rotatable to a second orientation to unseal the opening; and at least one cam surface structured to be operatively coupled to the cylinder so as to be rotatable about an exterior of the cylinder to engage the valve so as to produce rotation of the valve.

2. An opposed piston engine including a valve mechanism in accordance with claim 1.

3. The engine of claim 2 wherein the engine is a diesel engine.

4. The valve mechanism of claim 1 further comprising a member structured to be mountable on an exterior of the cylinder so as to be rotatable along the cylinder exterior, and wherein the at least one cam surface is formed on the member.

5. The valve mechanism of claim 4 wherein another at least one cam surface is formed on the member, the other at least one cam surface being structured to engage the valve so as to produce rotation of the valve.

6. The valve mechanism of claim 5 wherein the valve has a first actuator and a second actuator formed thereon, wherein the first actuator is structured to engage the at least one cam surface and not the other at least one cam surface during rotation of the member, and wherein the second actuator is structured to engage the other at least one cam surface and not the at least one cam surface during rotation of the member.

7. The valve mechanism of claim 1 wherein the valve is pivotally attached at one side thereof to an edge of an associated valve port formed in the cylinder.

8. The valve mechanism of claim 4 further comprising another member structured to be mountable on an exterior of the cylinder opposite the member and structured so as to be rotatable along the cylinder exterior to rotate about the cylinder, the other member including at least one other cam surface structured to be operatively coupled to the cylinder so as to be rotatable about the cylinder to engage the valve so as to produce rotation of the valve.

9. The valve mechanism of claim 8 wherein the at least one cam surface is structured to engage the valve so as to produce a rotation of the valve at a first point in time during the engine cycle, and the at least one other cam surface is structured to engage the valve so as to produce a rotation of the valve at a second point in time during the engine cycle, and wherein the second point in time is different from the first point in time.

10. The valve mechanism of claim 8 wherein the member and the other member are structured to enable coupling thereof to the cylinder so as to rotate in conjunction with each other, at the same speed and in the same direction.

11. The valve mechanism of claim 4 wherein the member has gear teeth formed along a surface thereof.

12. The valve mechanism of claim 1 wherein the at least one cam surface is structured so as to vary in radial distance from a central axis of the cylinder along an extent of the at least one cam surface.

13. The valve mechanism of claim 7 wherein the at least one cam surface is structured to contact a follower formed on the valve, and wherein the valve mechanism is structured such that motion of the follower along the at least one cam surface rotates the valve to the first position and to the second position.

14. The valve mechanism of claim 1 wherein the valve is structured to be hingedly connected to the cylinder.

15. The valve mechanism of claim 4 wherein the member is structured such that the at least one cam surface travels around a circumference of the cylinder as the member rotates about an exterior of the cylinder.

16. The valve mechanism of claim 4 further comprising another valve and another member positioned opposite the member and structured to rotate the cylinder, the other member including at least one other cam surface operatively coupled to the cylinder so as to be rotatable about the cylinder to engage the other valve so as to produce rotation of the other valve.

17. The valve mechanism of claim 14 wherein the valve is structured to be connected to the cylinder by a hinge mechanism, and wherein the valve is structured to engage the at least one cam surface so as to produce rotation of the valve about the hinge mechanism.

18. The valve mechanism of claim 1 wherein the valve comprises at least one actuating arm, and a cam follower mechanism coupled to the actuating arm and structured to engage the at least one cam surface so as to produce rotation of the valve.

19. The valve mechanism of claim 5 further comprising another valve and wherein a further at least one cam surface is formed on the member and spaced radially outwardly from both the at least one cam surface and the other at least one cam surface, the further at least one cam surface being structured to engage the other valve so as to produce rotation of the other valve.

20. The valve mechanism of claim 1 wherein the valve includes:

a plate portion having a combustion chamber face;

a pivot portion connected to the plate portion and structured for pivotable coupling to the non-rotating cylinder; and an actuator portion structured to engage the at least one cam surface during rotation of the at least one cam surface.

* * * * *

UNITED STATES PATENT AND TRADEMARK OFFICE

CERTIFICATE OF CORRECTION

PATENT NO. : 9,249,693 B2
APPLICATION NO. : 12/645287
DATED : February 2, 2016
INVENTOR(S) : Warren et al.

It is certified that error appears in the above-identified patent and that said Letters Patent is hereby corrected as shown below:

In the Specification

Column 4; Line 9; Please delete "21011" and insert --210b--.

Column 9; Line 28; Please delete "," and insert --.--.

Column 11; Line 23; Please delete "an" and insert --a--.

Column 12; Line 16; Please delete "tire" and insert --fire--.

Signed and Sealed this
Tenth Day of May, 2016

Michelle K. Lee

Michelle K. Lee
*Director of the United States Patent and Trademark Office*